United States Patent [19]

Hales et al.

[11] 4,001,978

[45] Jan. 11, 1977

[54] APPARATUS FOR SHAPING THE EDGE OF A BLADE ELEMENT

[75] Inventors: Louis S. Hales; Don R. Hamilton; Harry F. Weller; Donald E. Burgbacher, all of Cincinnati, Ohio

[73] Assignee: General Electric Company, Cincinnati, Ohio

[22] Filed: Apr. 1, 1975

[21] Appl. No.: 564,066

[52] U.S. Cl. ..... 51/100 R; 51/102

[51] Int. Cl.[2] ..... B24B 17/02; B24B 19/14

[58] Field of Search ..... 51/100 R, 101 R, 102, 51/135, 137, 143, 128; 90/13.5

[56] References Cited

UNITED STATES PATENTS

| | | | |
|---|---|---|---|
| 2,294,715 | 9/1942 | Bruno | 51/102 |
| 2,640,303 | 6/1953 | Johnson | 51/135 R |
| 3,427,753 | 2/1969 | Hoch | 51/102 X |
| 3,656,263 | 4/1972 | Jacobsen | 51/128 X |

FOREIGN PATENTS OR APPLICATIONS

| | | | |
|---|---|---|---|
| 530,929 | 1/1922 | France | 51/102 |

*Primary Examiner*—Harold D. Whitehead
*Assistant Examiner*—Nicholas P. Godici
*Attorney, Agent, or Firm*—Henry J. Policinski; Derek P. Lawrence

[57] ABSTRACT

An apparatus for shaping the edge of a blade element including first means for removing material from the blade having a first position to engage a portion of the edge of the blade, second means for supporting the blade during translation thereof relative to the first means while successive portions of the blade are in engagement with the first means, third means for guiding the blade during translation and for presenting the edge portions for engagement with the first means at a predetermined angle and fourth means for holding the first means, the second means and the third means against translational movement with respect to each other.

8 Claims, 6 Drawing Figures

VENT

APPARATUS FOR SHAPING THE EDGE OF A BLADE ELEMENT

BACKGROUND OF THE INVENTION

The present invention relates to turbomachines and, more particularly, to means for shaping or reshaping an edge of a blade generally associated with turbomachines.

Blade elements used in turbomachines generally have a complex geometrical configuration designed to provide a desired aerodynamic interaction of the blade with the fluid working medium which will contribute to the optimum cycle efficiency of the turbomachine. A typical blade may vary in stagger angle, chord length, camber angle and thickness from blade tip to blade root. Fabrication of such blades is likewise a complex task, especially the shaping of the leading edge of the blade whose profile is critical to achieving the maximum cycle efficiency of the turbomachine. The blade configuration causes the position of the leading edge relative to the blade root to vary three dimensionally from blade root to blade tip and a profiling tool must follow the twisting leading edge along the length of the blade.

While the leading edge may exhibit the desired profile immediately after original manufacture, the leading edge is subject to erosion and damage from impinging contact with the fluid medium and foreign objects ingested into the turbomachine during its life in a field environment. As a result of erosion and damage, the leading edge loses its most efficient aerodynamic contour and must periodically be reshaped or recontoured to maintain maximum cycle efficiency.

Prior art devices used to shape the leading edge of turbomachinery blades to a desired profile have been of several types. The completely automatic or programmed device in which the position of the leading edge of the blade with respect to the cutting or grinding tool is automatically controlled by electromechanical means pre-programmed to provide the proper engagement of the leading edge and the tool. These automatic devices are complicated and prohibitively expensive. Scrapers, which are essentially manually operated tools configured specifically for shaping the leading edge of single blade configurations, are by their manual nature not suitable for precise, consistent and repeatable leading edge contouring. Additionally, scraping tools are difficult to manipulate and fatiguing to the operator. Free standing motor-driven abrasive wheels and belts have also been used for shaping the leading edges of the blades. Application of such devices requires significant judgement on the part of the operator in maintaining the edge in proper engagement with the abrasive and further requires, even with experienced operators, continuous inspection and extensive rework. In other prior art devices blades are fixtured and translated relative to an abrasive element. These devices have proven to be either costly or limited to shaping blades of relatively simple geometry because translation of not only the blade but also the fixture is required. None of these prior art devices has proven to be satisfactory for inexpensive, efficient, consistent and precise shaping or reshaping of the leading edge of turbomachine blades to a desired profile.

SUMMARY OF THE INVENTION

It is therefore a principal object of the present invention to provide an improved device for shaping or reshaping an edge of a blade element of a turbomachine.

It is a further object of this invention to provide such a shaping or reshaping device which accomplishes shaping of the leading edge in a precise, consistent and repeatable manner and which requires minimum operator judgement, minimum inspection and minimum rework.

It is still another object of this invention to provide such a shaping or reshaping device which is suitable for field use and results in little, if any, fatigue to the operator.

It is yet another object of this invention to provide a method of economically and efficiently machining the leading edge of a blade element of a turbomachine.

These and other objectives as well as advantages, which will become apparent hereinafter, are accomplished by the present invention which, in one form, provides an apparatus and method for shaping or reshaping the leading edge of a blade element comprised of motive means, first means driven by said motive means for removing material from the blade, the first means having a first position wherein the first means engages a portion of the edge for removing material from the blade, second means adapted to engage the blade for supporting the blade during translational movement of the blade relative to the first means while successive portions of the edge engage the first means and third means for guiding the blade during said translational movement and for presenting the edge portion for engagement with the first means at a predetermined angle. Fourth means are provided for holding said first, second and third means against translational movement during the shaping operation.

DESCRIPTION OF THE DRAWINGS

The above and other related objects and features of the present invention will be apparent from a reading of the following description in conjunction with the accompanying drawings wherein.

DETAILED DESCRIPTION

Figure 1:
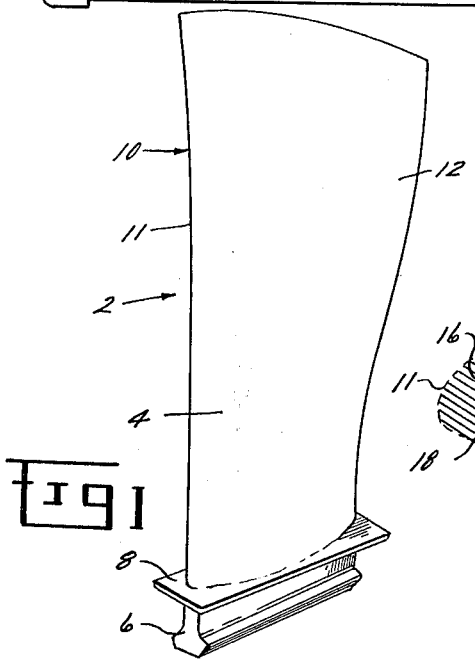
FIG. 1 is a perspective view of a typical blade of a turbomachine.

Referring now to FIG. 1 of the drawings, a typical blade, shown generally at 2 is comprised of an airfoil section 4, a mounting root 6 and a platform section 8. Leading edge 10 and trailing edge 12 which extend outwardly from the blade platform 8 are an integral part of the airfoil section 4.

Figure 2:
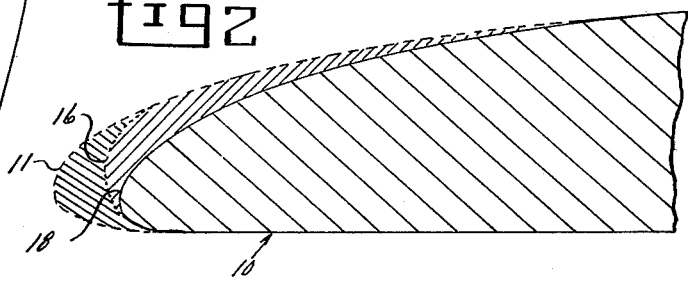
FIG. 2 is an enlarged cross-sectional view of the leading edge of the blade.

FIG. 2 depicts the enlarged sectional contour or profile of leading edge 10. Leading edge 10 is originally manufactured to exhibit an ideal profile 11. In field use however, impingement of the fluid medium and foreign objects on the blade 2 and particularly on the leading edge 10 erodes profile 11 such that it assumes a blunted profile 16 resulting in the airfoil losing its originally manufactured aerodynamic contour thereby contributing to the loss of cycle efficiency of the turbomachine. As an alternative to replacing the entire blade 2, the blunted edge 16 may be reshaped to exhibit a profile 18 as shown in FIG. 2 which is observed to be of a contour similar to the original contour 11 thus reinstating the original aerodynamic characteristics of the airfoil 4. The present invention is well adapted to be used in either shaping of leading edge 10 to profile 11 in the original manufacturing process or in reshaping to profile 18 after field use of blade 2.

Figure 4:
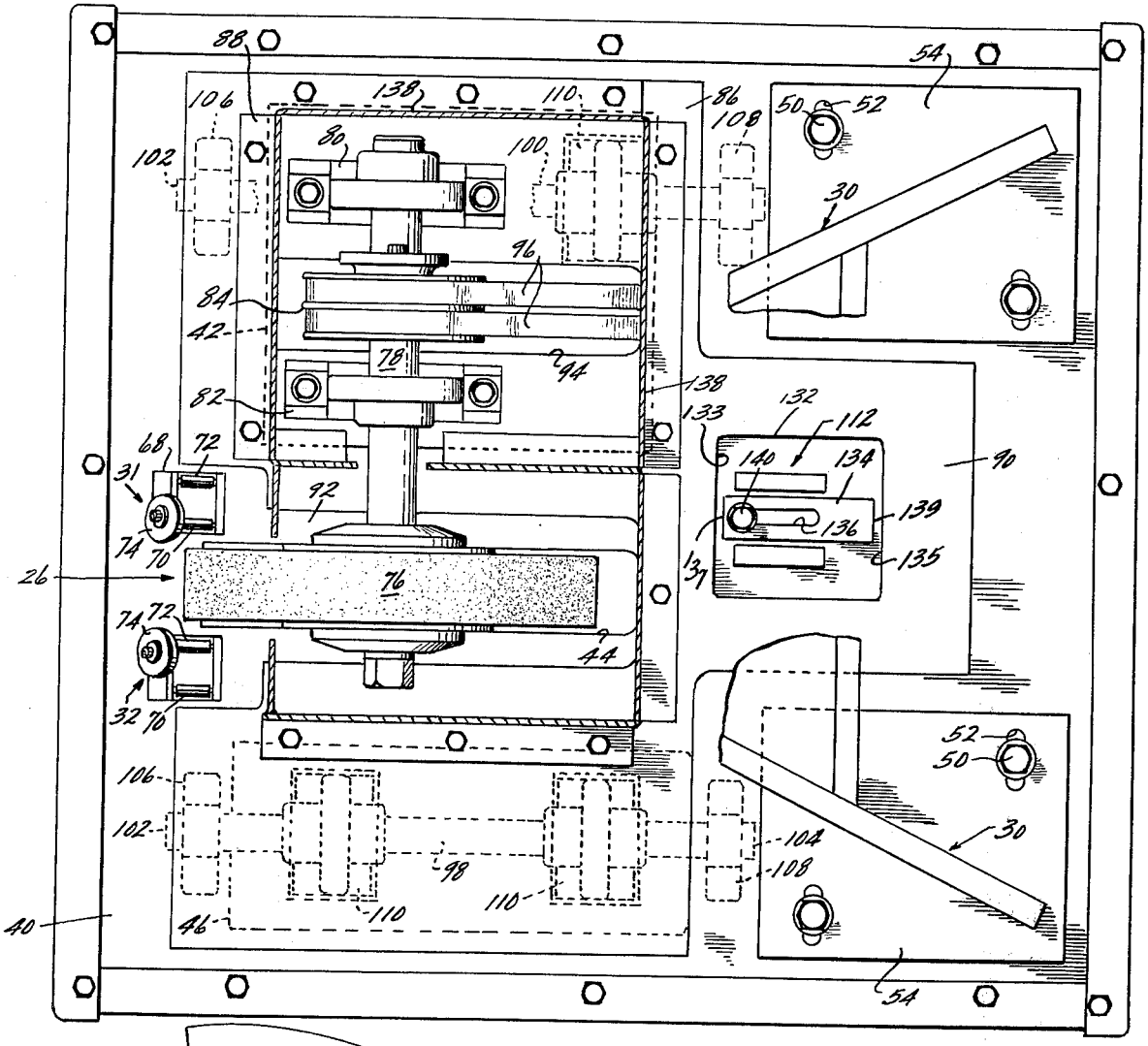
FIG. 4 is a top view of the apparatus with the cam and a portion of the cam support arm removed such that the remaining portions of the apparatus can be viewed without obstruction.
Figure 3:
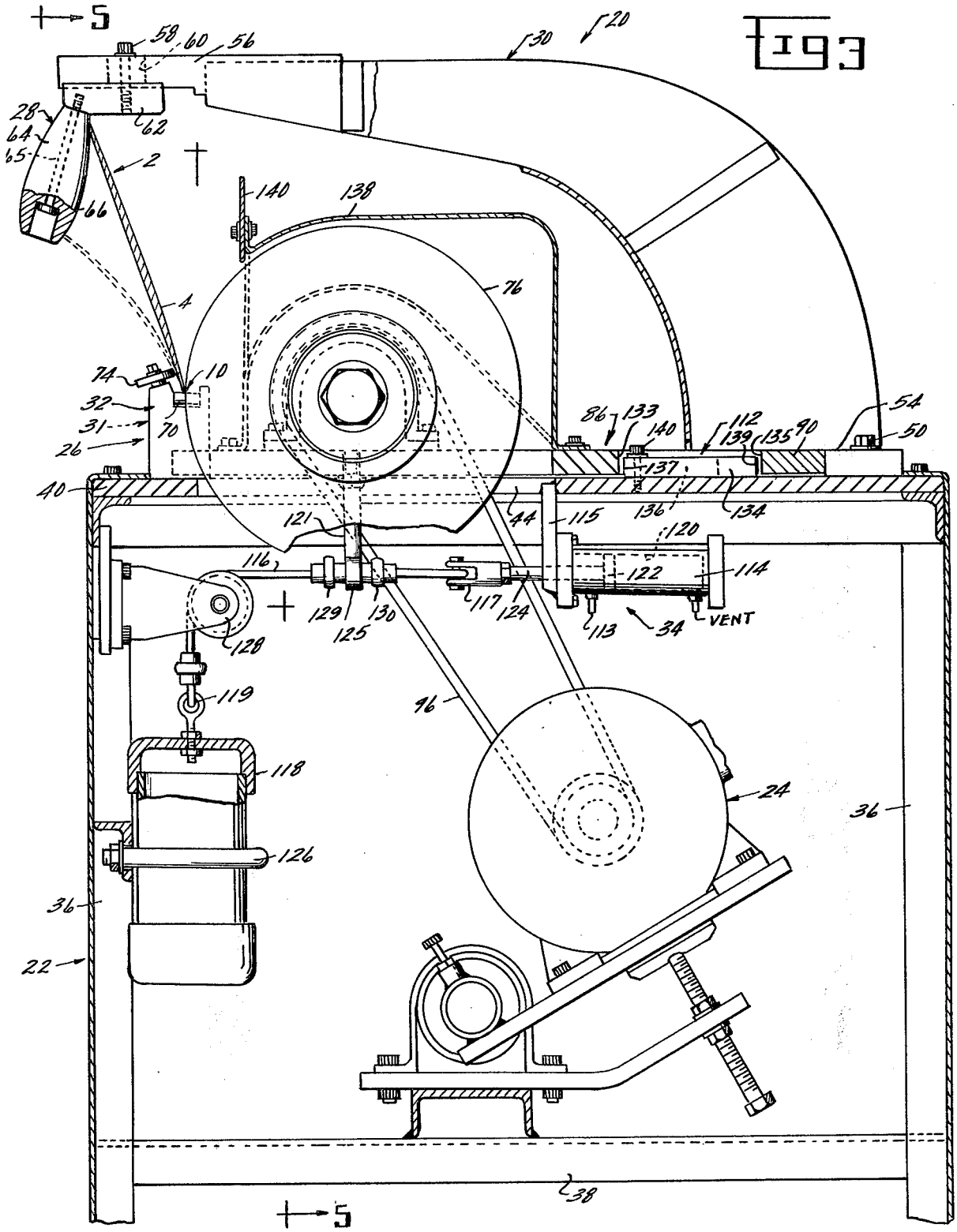
FIG. 3 is a side view of the apparatus of the present invention for shaping the leading edge of a blade showing portions of the apparatus in cross section.
Figure 5:
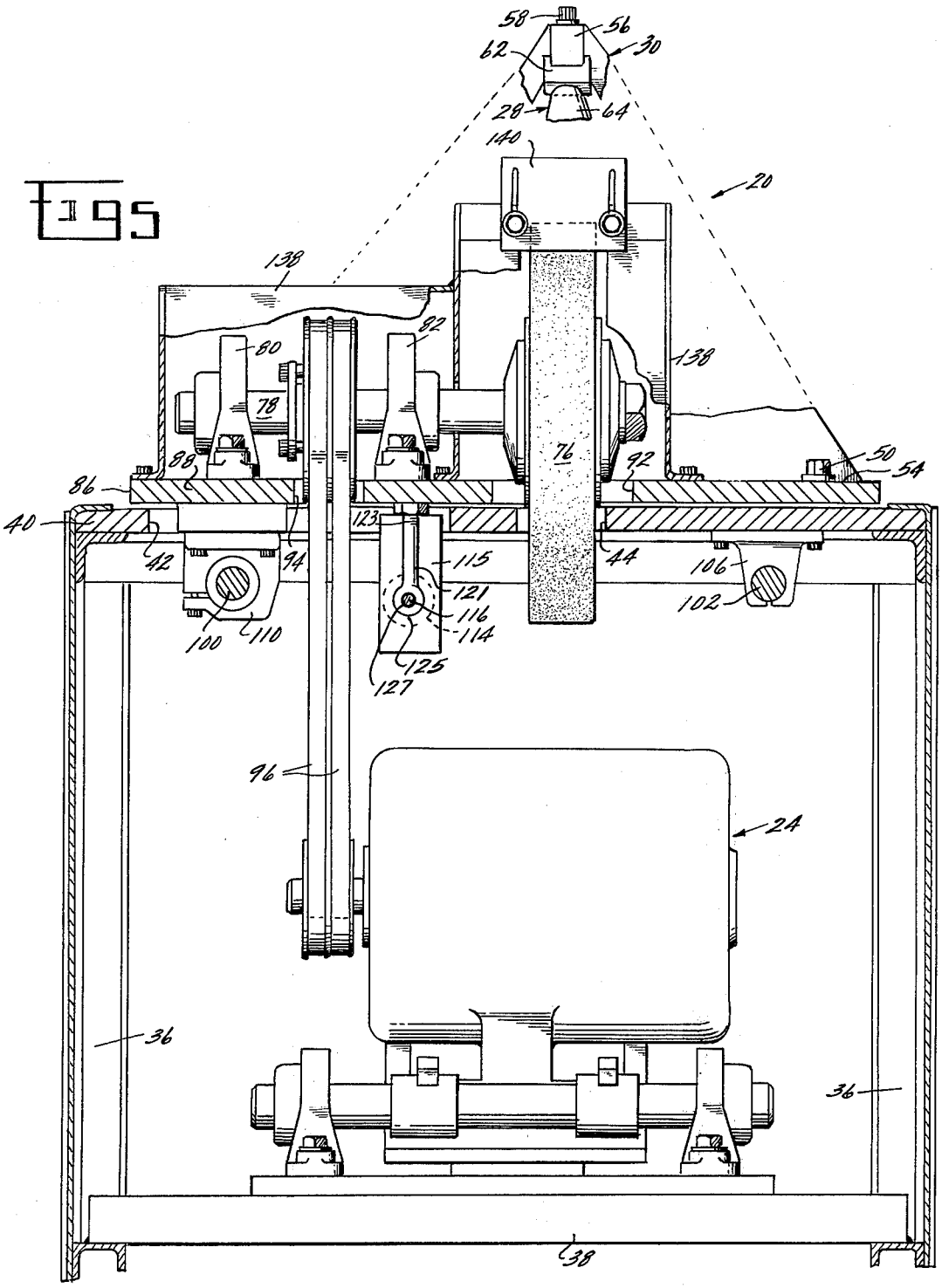
FIG. 5 is an end view of the apparatus showing a portion of the apparatus in cross section taken on line 5—5 of FIG. 3.

Referring now to FIGS. 3, 4 and 5, the blade edge shaping apparatus of the present invention is generally shown at 20 for shaping the edge 10. FIG. 3 further depicts blade 2 as it is associated with the apparatus during the shaping operation. The apparatus is comprised generally of a work table 22, a motor drive assembly 24 rigidly affixed to the work table 22, a grinding wheel assembly 26 slidably mounted to work table 22 and driven by motor drive assembly 24, a cam assembly 28 and cam support arm 30 rigidly affixed to work table 22, blade support pads 31 and 32 also rigidly affixed to work table 22, and a retraction mechanism 34 for biasing the grinding wheel assembly into engagement with airfoil 4 at a constant applied pressure and for retracting the grinding wheel assembly 26 from the airfoil 4. Apparatus 20 generally accomplishes the objectives of this invention by shaping leading edge 10 as blade 2 is translated across grinding wheel assembly 26 while in engagement therewith.

Work table 22 can be constructed in any manner sufficient to adequately support the other elements of the shaping apparatus 20. Work table 22 is comprised of a plurality of vertical legs 36, as shown in FIG. 3, interconnected at their lower ends by horizontal bracing members 38 and rigidly joined at their upper ends to base plate 40. Base plate 40 is generally of rectangular shape and serves to provide a firm surface to which cam support arm 30, blade support pads 31 and 32 and the grinding wheel assembly are attached. Three generally rectangular shaped passages 42, 44 and 46 are formed in base plate 40 for the purpose of permitting portions of the other elements of the apparatus to pass therethrough in a manner herinafter to be described.

Cam support arm 30 is rigidly but adjustably affixed to base plate 40 by four bolts 50 passing through four elongated apertures 52 in one end 54 of cam support arm 30 and threadably received by base plate 40. Hence, cam support arm 30 can be adjusted by loosening bolts 50 and shifting cam support arm 30 in the direction of elongation of apertures 52 and then retightening bolts 50 to secure cam support arm 30 immovably to base plate 40. Cam support arm 30 is generally of arcuate shape with its one end 54 secured to base plate 40 and its other end 56 positioned above base plate 40. Cam assembly 28 is adjustably but rigidly mounted to end 56 of cam support arm 30 by bolt 58 which extends through elongated aperture 60 in end 56 and which is threadably received by cam assembly 28. Cam assembly 28 is adjustable with respect to cam support arm 30 along a line perpendicular to the line along which cam support arm 30 is adjustable. Hence, the position of cam assembly 28 can be adjusted either by adjustment of the cam assembly 28 itself through bolts 58 and apertures 60 or by adjustment of cam support arm 30 through bolts 50 and apertures 52.

Cam assembly 28 is comprised of a base portion 62 and a cam portion 64 having a preselected cam surface 66. Cam portion 64 is mounted to base portion 62 by pin 65 which passes through cam portion 64 and is threaded into base portion 62.

Spaced apart blade support pads 31 and 32 are rigidly fixed to base plate 40. Each of support pads 31 and 32 are comprised of a stationary support 68, horizontal rollers 70 and 72 rotatably mounted to support 68 for supporting the blade 2 against vertical movement and roller 74 rotatably mounted to support 68 for supporting the leading edge 10 against lateral movement. Rollers 70, 72 and 74 serve to locate leading edge 10 generally with respect to grinding wheel assembly 26.

Grinding wheel assembly 26 is comprised of grinding wheel 76 made of an elastically deformable abrasive material, shaft 78 to which grinding wheel 76 is rigidly attached, mounting blocks 80 and 82 which receive and support the shaft 78 and attached grinding wheel 76 during rotation, and pulley 84 also rigidly attached to shaft 78. While the apparatus disclosed in the drawings depicts a grinding wheel as the means for removing material from blade 2, other abrasive elements such as a flexible abrasive belt are equally appropriate. Grinding wheel 76 protrudes between blade support pads 31 and 32 whereby the blade 2 can be supported on both sides of grinding wheel 76 immediately adjacent the area of engagement of the blade 2 and grinding wheel 76. Mounting blocks 80 and 82 are securely mounted to floating plate 86 as by bolting, welding or other conventional means whereby grinding wheel assembly is securely mounted for rotation on floating plate 86.

Floating plate 86 is a generally flat plate positioned above base plate 40 and has a mounting section 88, to which grinding wheel assembly 26 is attached, and an integrally formed appendage 90. Floating plate 86 is provided with a centrally located recess 92 into which grinding wheel 76 protrudes and a slot 94 into which drive pulley 84 protrudes. Slot 94 permits access for grinding wheel assembly 26 to be rotatably driven by motor assembly 24 and drive belt 96. Motor assembly 24 is mounted by conventional means to work table 22 and serves to provide the motive force to operate grinding wheel 76.

Floating plate 86 is slideably mounted on base plate 40 for selected reciprocal movement with respect to base plate 40 in a manner now to be described. Rods 98 and 100 (shown in FIG. 4) are provided in the present invention for supporting plate 86 in a slideable manner relative to base plate 40. Rods 98 and 100 are each affixed to base plate 40 at each of their ends 102 and 104 by mounting lugs 106 and 108 respectively. Mounting lugs 106 and 108 are anchored to the bottom surface of base plate 40 by bolting, welding or other conventional means. Floating plate 86 is slidingly supported on rods 98 and 100 by four bearing blocks 110, two of which are located in passage 42 and are associated with rod 98 and two of which are located in passage 46 and are associated with rod 100. Each bearing block is rigidly secured to floating plate 86 and has means to receive the central portion of their respective associated rod for sliding reciprocal movement thereon. Hence, rods 98 and 100 are affixed to base plate 40 by mounting lugs 106 and 108 and floating plate 86 is adapted for reciprocal movement with respect to base plate 40 by sliding movement of bearing blocks 110 on rods 98 and 100. (Rods 98 and 100, mounting lugs 106 and 108 and bearing blocks 110 are not shown in FIG. 3, while only one mounting lug 106 and one bearing block 110 are shown in FIG. 5)

Reciprocal sliding movement of floating plate 86 is controlled and limited by retraction mechanism 34 in cooperation with stop means shown generally at 112. Retraction mechanism is generally comprised of a retraction cylinder 114, a flexible cable 116 and a biasing member 118. Retraction cylinder 114 is carried by bracket 115 welded to base plate 40. Cylinder 114 has an internally formed cylindrical chamber 120 and a piston 122 positioned in chamber 120 for movement therein. Means 113 are provided whereby a pressurized medium may be applied to chamber 120 on the left side of piston 122. A vent is provided in cylinder 114 to maintain atmospheric pressure in chamber 120 on the right side of piston 122.

Flexible cable 116 is journaled at one of its ends 117 to piston rod 124 which is connected to piston 122 and at its other end 119 to biasing member 118. Disposed between the ends 117 and 119 is a connecting link 121 having one of its ends 123 threaded into floating plate 86. The other end 125 is formed with an eyelet 127 adapted to receive flexible cable 116. Locking elements 129 and 130 are clamped to flexible cable 116 on each side of eyelet 127 thereby preventing connecting link 121 from relative movement with cable 116.

Biasing member 118, which is essentially a free-hanging weight loosely bracketed to one of the vertical legs 36 by bracket 126, exerts a downward force (as shown in FIG. 3) on cable 116. Cable 116 cooperates with pulley assembly 128 (which is firmly affixed to vertical leg 36) to transform the downward vertical force exerted by biasing member 118 into a horizontal force acting on connecting link 121 and hence on floating plate 86.

Stop means 112 serves to limit retraction of floating plate 86 by retraction cylinder 114. Stop means 112 is generally comprised of a rectangular slot 132 in appendage 90 of floating plate 86 having a forward edge 133 and a rearward edge 135, a stop member 134 having a forward facing abutment edge 137 and a rearward facing abutment edge 139 and bolt means 140 for releaseably securing stop member 134 to base plate 40. Elongated slot 136 is provided in stop member 134 and admits bolt means 140 which is threaded into base plate 40.

Elongated slot 136 permits adjustment of stop member 134 in the direction of elongation of slot 136 thereby providing for variation in the amount of retraction of floating plate 86 and further providing for desired amounts of retraction as the diameter of grinding wheel 76 is reduced due to normal wear during the reshaping process.

Grinding wheel 76, shaft 78, mounting blocks 80 and 82 and pulley 84 are enclosed by a protective shroud 138 which serves to prevent abrasive or metal particles removed during the grinding process from striking the operator of the apparatus. An adjustable shield plate 140, attached to shroud 138, is positioned close to grinding wheel 76 to prevent particles from being ejected from the shroud enclosure by the grinding wheel 76. Shield plate 140 is adjustable to permit the shield plate 140 to be positioned in close proximity to the grinding wheel 76 for various stages of wear of grinding wheel 76.

Figure 6:
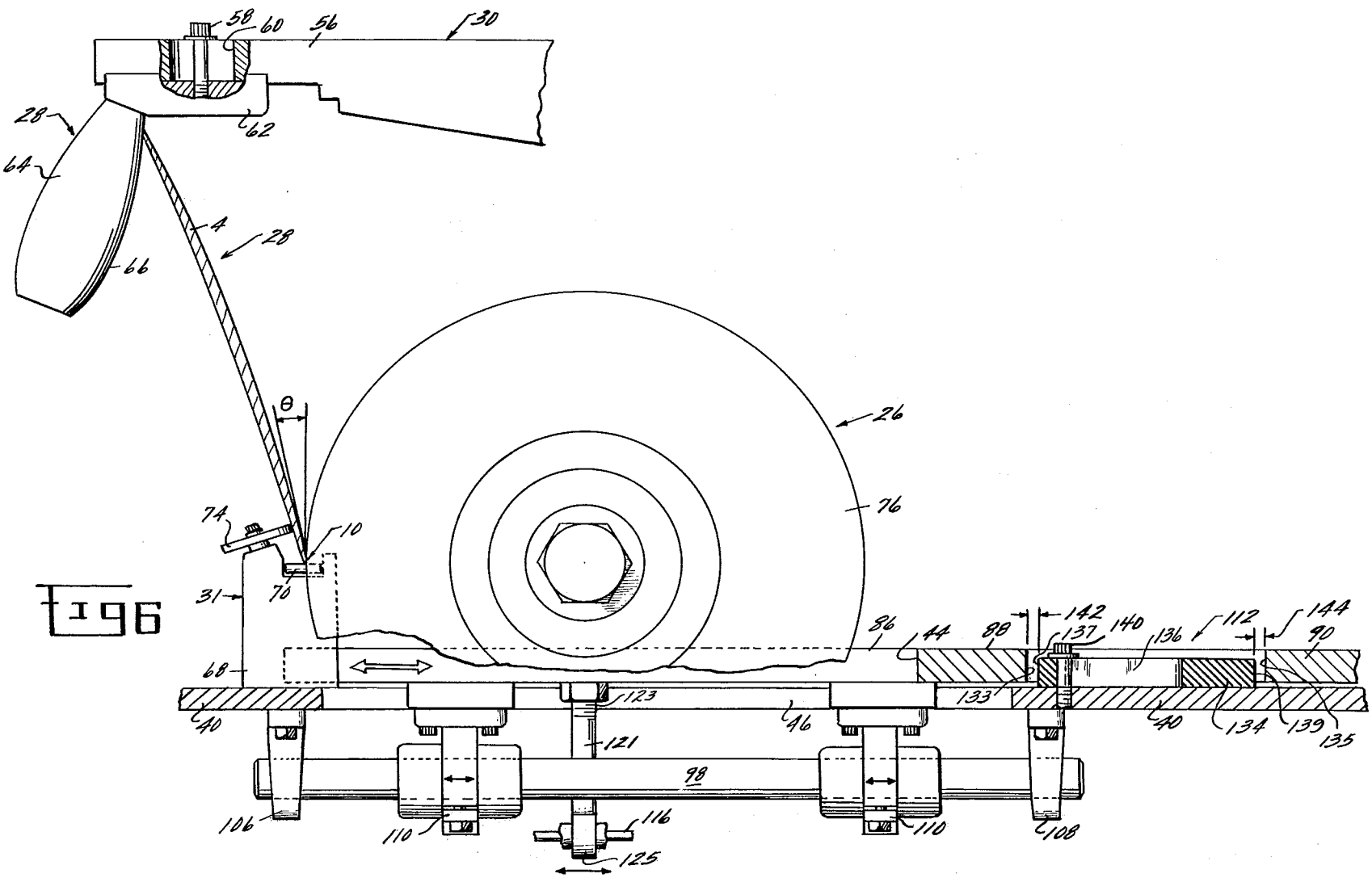
FIG. 6 is an enlarged fragmentary view of a portion of the apparatus.

Referring now to FIG. 6, a portion of the shaping apparatus is shown in the position wherein the blade 2 is engaged with grinding wheel 76 for reshaping of the leading edge 10. In this position, the floating plate 86 is biased to its forward position (that is, to the left as viewed in FIG. 6), and a gap 142 is produced between forward edge 133 of slot 132 and forward facing abutment edge 137. A gap 144 also is maintained between rearward edge 135 of slot 132 and rearward facing abutment 139.

In FIG. 6, a typical cross section of airfoil 4 is depicted with its leading edge 10 in engagement with grinding wheel 76. The portion of the leading edge in engagement is presented to the grinding wheel at a predetermined angle $\theta$ which is selected to provide shaping of the leading edge 10 to the desired profile. Presentation of the leading edge 10 to the grinding wheel 76 at the predetermined angle $\theta$ is effected by maintaining the airfoil 4 in simultaneous engagement with horizontal rollers 70 and 72, vertical roller 74 and cam surface 66 which are positioned in accordance with a preselected spacial relationship with respect to each other. Horizontal rollers 70 and 72 and vertical rollers 74 provide support to blade 2 during the grinding shaping operation and serve generally to establish and locate the position of leading edge 10 with respect to grinding wheel 76. Cam surface 66 provides a guide for the trailing edge 12 of airfoil 4 and is positioned and configured such that if airfoil 4 is in engagement with rollers 70, 72 and 74 and cam surface 66, then airfoil 4 will be in an attitude whereby the portion of leading edge 10 presented to the grinding wheel will be presented at the predetermined angle $\theta$. More specifically, cam surface 66 is configured such that it represents the loci of all points of the trailing edge as successive portions of the leading edge are presented to the grinding wheel 76 at the desired angle $\theta$ while the airfoil is in engagement with rollers 70, 72 and 74. Hence, if the airfoil 4 is translated in a direction traverse to grinding wheel 76 while it is in engagement with the aforementioned rollers and with cam surface 66, then each successive portion of the leading edge 10 presented to the grinding wheel 26 for shaping will be presented at the predetermined angle $\theta$. Consequently the proper profile will be given to leading edge 10 along the entire length of airfoil 4 regardless of variations in chord length, blade twist, camber angle or blade thickness.

While the apparatus is readily capable of accomplishing the objectives of the present invention with only one support pad 31 or 32, the preferred embodiment provides two spaced apart support pads 31 and 32 to give increased stability to the blade during the shaping process.

As described above, each successive portion of the leading edge 10 is presented to grinding wheel 76 at a predetermined angle $\theta$. Angle $\theta$ may be constant, that is, the same for each successive portion of leading edge 10, or angle $\theta$ may differ for successive portions of leading edge 10. Whether angle $\theta$ is constant or variable, cam surface 66 can be configured such that the desired angle $\theta$ for each portion of leading edge 10 is achieved. This is accomplished by configuring cam surface 66 to represent the loci of all points on the trailing edge as successive portions of the leading edge are presented to grinding wheel 76 at their respective angle $\theta$ while the airfoil 4 is in engagement with rollers 70, 72 and 74. Furthermore, if the configuration of airfoil requires, cam portion 64 of cam assembly 28 can be rotatably mounted to base portion 62 by pin 66 such that cam 64 rotates as airfoil 4 is translated across grinding wheel 76.

The operation of the shaping or reshaping apparatus 20 will now be described. Reshaping of the leading edge 10 is generally accomplished by translating the blade 2 in a direction parallel to the axis of rotation of grinding wheel 76 while the leading edge 10 is in engagement with grinding wheel 76. As previously discussed, when it is desired to remove or insert a blade 10 into apparatus 20, chamber 120 is pressurized to the left of piston 122 by pressurizing means 113 (as viewed in FIG. 3). The pressurized fluid medium acting on piston 122 overcomes the force exerted by biasing member 118 through flexible cable 116 on floating plate 86 and pulls floating plate 86 to the right until forward edge 133 of slot 132 engages forward facing abutment edge 137. In this position, floating plate 86 and hence the grinding assembly 26 is withdrawn from blade support pads 31 and 32 thereby providing clearance for insertion of an airfoil 4 into the apparatus 20.

Next, an airfoil 4 is inserted into the aforementioned clearance and positioned such that its leading edge rests upon horizontal rollers 70 and 72 and vertical rollers 74 and such that its trailing edge 12 engages cam surface 66. Positioning the airfoil 4 in this manner will present a portion of leading edge 10 at the predetermined angle $\theta$ to the grinding wheel 76 for shaping or reshaping.

With the blade positioned as described above, motor drive assembly 24 is energized (by conventional switch means not shown) thereby rotating drive belt 96, pulley 42, shaft 78 and grinding wheel 76. After grinding wheel 26 has attained the proper steady state rotational speed, the pressure in chamber 120 to the left of piston 122 is relieved (by control means not shown). The force exerted by the weight of biasing member 118 pulls floating plate 86 and hence grinding assembly 26 to the left and into engagement with the presented portion of leading edge 10 whereby the presented portion is shaped or reshaped to the desired contour.

Biasing member maintains engagement of leading edge 10 and grinding wheel 76 with a constant applied force or pressure. Since the grinding wheel is comprised of an elastically deformable, abrasive material, the grinding wheel engages the presented portion of leading edge 10 in area contact rather than in point or line contact thereby evenly distributing the constant applied force over the leading edge 10 resulting in a smooth and evenly contoured shaped profile. Use of a rigid abrasive material causes the reshaped profile to have a concave shape when viewed in cross section and further prevents a smooth blending zone between the reshaped leading edge 10 and the remainder of airfoil 4.

With the apparatus 20 in this applied position, blade 10 and hence airfoil 4 are translated by manual or mechanized means in a direction parallel to the axis of rotation of the grinding wheel while its leading and trailing edges are held in contact with rollers 70, 72 and 74 and cam 66. Translation of airfoil 4 in this manner presents successive portions of leading edge 10 to the grinding wheel for reshaping. The predetermined spacial relationship between rollers 70, 72 and 74 and cam surface 66 and the predetermined configuration of cam surface 66 ensure that the airfoil 10 will be maintained in a suitable attitude such that each successive presented portion of leading edge 10 will be presented to the grinding wheel 76 at the predetermined angle $\theta$. Furthermore, the airfoil 4 can be translated back and forth across the grinding wheel 76 if it is necessary to remove additional material to effect proper contouring of leading edge 10. After the leading edge 10 has achieved the proper profile along the entire length of airfoil 4, pressurized fluid is again introduced into the chamber 120 to cause the floating plate 86 to be retracted to the right in the same manner as hereinbefore described. The blade 2 is then removed from the apparatus 20.

As a number of blades are machined on the apparatus 20, the grinding wheel 76 may become worn such that the rearward edge 135 of slot 132 engages rearwardly facing abutment edge of stop member 134 thereby preventing the grinding wheel 76 from properly engaging the presented leading edge. In this instance, stop member 134 is adjusted by loosening bolt means 140, moving stop member 134 to the left and retightening bolt means 140.

It is readily apparent from the description of the present invention as set forth above that the rollers 70, 72 and 74, cam surface 66 and grinding wheel 76 are held against translation with respect to each other during the shaping operation. Hence, with the present invention additional means need not be provided, as with prior art devices, for guiding the location and supporting elements for translation. Consequently, the present invention is less costly than prior art devices and not restricted to blades of relatively simple configuration.

From the foregoing, it is now apparent that a shaping apparatus and method have been provided which is well adapted to fulfill the aforestated objects of the invention and that while only one embodiment of the invention has been described for purposes of illustration, it will be apparent that other equivalent forms of the invention are possible within the scope of the appended claims.

We claim:

1. An apparatus for shaping to a predetermined profile an edge of a blade, translatable in said apparatus, said blade having a leading edge and a trailing edge, comprising:

motive means;

first means driven by said motive means for removing material from said blade, said first means having a first position wherein said first means engages a portion of one of said edges;

second means engaging said blade for supporting said blade during translation of said blade relative to said first means while successive portions of said one of said edges engage said first means in said first position;

third means engaging said blade for guiding said blade during said translation and for presenting said edge portion for engagement with said first means at a predetermined angle said third means including a cam surface having a predetermined configuration selected to represent the loci of a portion of said blade when successive portions of said one of said edges are presented for engagement with said first means at said predetermined angle, said cam surface being further configured to represent at least one of said loci which does not occupy the same point in space as other of said loci as successive portions of said blade are presented for engagement with said first means at said predetermined angle; and fourth means for holding said first means, said second means and said third means against translational movement with respect to each other during shaping of said edge.

2. The apparatus as set forth in claim 1 wherein said cam surface engages said blade at the other of said edges.

3. The apparatus as set forth in claim 2 wherein said cam surface is configured to represent the loci of said other of said edges when said successive portions of said one of said edges are presented for engagement with said first means at said predetermined angle.

4. The apparatus of claim 1 wherein said fourth means comprises biasing means operably connected to said first means to bias said first means toward and into engagement with said one of said edges at a constant pressure.

5. The apparatus of claim 4 further comprising means for overcoming said biasing means and for moving said first means to a second position wherein said first means is not in engagement with said portion of one of said edges thereby permitting removal of said blade.

6. The apparatus of claim 1 wherein said first means comprise an elastically deformable abrasive wheel.

7. The apparatus of claim 1 wherein the predetermined angle varies in magnitude as said successsive portions of said one edge are presented.

8. An apparatus for shaping the leading edge of a turbomachinery blade translatable in said apparatus, said blade having a leading edge and a trailing edge comprising:

a work table;

a motor carried by said work table;

an abrasive element slidably secured to said work table and driven by said motor, said abrasive element having a first position for engaging a portion of said leading edge;

a biasing element operatively connected to said abrasive element to bias said abrasive element in said first position;

a support pad carried by said work table and adapted to engage said blade and support said blade during translation of said blade relative to said abrasive element while successive portions of said leading edge engage said grinding element; and a cam adjustably secured to said work table, said cam having a cam surface adapted to engage said trailing edge, said support pad and said cam surface cooperating to locate and to present said portion of said leading edge for engagement with said abrasive element at a predetermined angle and predetermined location.

* * * * *